US005249335A

United States Patent [19]

Jones

[11] Patent Number: 5,249,335

[45] Date of Patent: Oct. 5, 1993

[54] METHOD OF DELINTING COTTON SEED

[75] Inventor: Clyde Jones, Scott, Miss.

[73] Assignee: Delta and Pine Land Company, Scott, Miss.

[21] Appl. No.: 869,133

[22] Filed: Apr. 15, 1992

Related U.S. Application Data

[63] Continuation-in-part of Ser. No. 676,761, Apr. 24, 1991, abandoned, which is a continuation of Ser. No. 530,842, May 30, 1990, abandoned.

[51] Int. Cl.[5] ..... D04B 1/04

[52] U.S. Cl. ..... 19/40; 19/55 R

[58] Field of Search ..... 19/40, 41, 55 R, 48 R, 19/42, 60, 54

[56] References Cited

U.S. PATENT DOCUMENTS

| | | | |
|---|---|---|---|
| 276,305 | 4/1883 | Taylor | 19/40 |
| 408,085 | 7/1889 | Collyer | 19/44 |
| 431,665 | 7/1890 | Marshall | 19/40 |
| 530,533 | 12/1894 | Johnson | 19/40 |
| 821,257 | 5/1906 | Ragsdale | 19/40 |
| 983,527 | 2/1911 | Worth | 19/40 |
| 1,244,131 | 10/1917 | Reynolds | 19/40 |
| 1,436,372 | 11/1922 | Vardell | 19/55 R |
| 1,728,018 | 9/1929 | Taylor | 19/55 R |
| 2,144,579 | 1/1939 | Sheppard, Jr. | 19/44 |
| 2,644,986 | 7/1953 | Pazandak | 19/44 |
| 2,724,148 | 11/1955 | McMath | 19/44 |
| 3,484,904 | 12/1969 | Berriman et al. | 19/39 |
| 3,925,849 | 12/1975 | Griffin, Jr. | 19/48 R |
| 3,959,851 | 6/1976 | Bledsoe | 19/48 A |
| 3,963,711 | 6/1976 | Harrell et al. | 19/64.5 |
| 4,563,794 | 1/1986 | Beeland | 19/48 R |
| 4,723,342 | 2/1988 | Strother et al. | 19/40 |
| 4,724,632 | 2/1988 | Bilsland et al. | 47/58 |
| 4,942,643 | 7/1990 | Kincer et al. | 19/41 |

FOREIGN PATENT DOCUMENTS

| | | | |
|---|---|---|---|
| 422801 | 11/1974 | U.S.S.R. | 19/41 |
| 1381206 | 8/1986 | U.S.S.R. | 19/55 R |
| 1061462 | 3/1967 | United Kingdom | 19/41 |

*Primary Examiner*—Clifford D. Crowder
*Assistant Examiner*—Michael A. Neas
*Attorney, Agent, or Firm*—Rothwell, Figg, Ernst & Kurz

[57] ABSTRACT

A method of delinting cotton seed comprises the steps of passing the cotton seed through a saw delinter to remove a substantial portion of the lint, preferably at least 40%, therefrom, and thereafter passing the partially delinted seed through a brush delinter to remove substantially all of the remaining lint therefrom.

In a preferred embodiment of the invention, the seed is passed through two saw delinting stages to remove more than about 40% in the first stage and up to about 20% or more in the second stage, whereby more than about 60% of the lint is removed in the two saw delinting stages. Subsequent passage of the seed through a brush delinter removes additional lint so that up to 97% of the lint is removed in the combination of the saw delinting and brush delinting steps. An optional further step of passing the seed through a flamer can be used to remove the remaining approximately 3% of the lint.

2 Claims, 4 Drawing Sheets

METHOD OF DELINTING COTTON SEED

CROSS REFERENCE TO RELATED APPLICATIONS

This application is a continuation-in-part of U.S. application Ser. No. 07/676,761, filed Apr. 24, 1991, (abandoned) which in turn is a continuation of U.S. application Ser. No. 07/530,842, filed May 30, 1990 (abandoned).

BACKGROUND OF THE INVENTION

1. Field of the Invention

The present invention relates generally to the processing of seed cotton and relates more particularly to a method for delinting cotton seed.

2. Description of the Prior Art

Cotton seed, following separation from the long cotton fibers in the ginning process, is covered with short lint, also known as linters. This short lint, hereinafter referred to simply as lint, is desirably removed from the seed to facilitate the further use of the seed for planting, or the production of cotton seed oil, and to permit collection of the lint for various commercial uses.

For removing lint from seed destined for oil production, it has been conventional practice to utilize several stages of saw type delinters which comprise closely spaced rotating saw blades with fine teeth which project through a comb-like series of ribs disposed between the blades and having a narrow clearance from the blades. The lint is removed by the blade teeth and swept through the slots between the ribs while the seed is diverted by the ribs. By appropriate adjustment of the saw type delinter, most of the lint can be mechanically removed from seed destined for oil production. Such delinted seed cannot, however, be used for planting purposes since the seed is damaged to some degree by repeated contact with the saw blades during this process such that its germinating potential is significantly reduced.

Accordingly, planting seed is conventionally delinted in different types of processes, most of which use one or another form of acid treatment to clean the lint from the seed. In one such process presently in use, the lint covered seed is first subject to a flame treatment in which some of the lint is removed by burning, following which the seed is subjected to an acid treatment at elevated temperature including tumbling in rotating cylinders to disengage and chemically remove the more tenacious lint fibers from the seed.

Although acid treatment produces a relatively good end product in terms of seed germination percentage, the process itself is expensive, difficult to control, can create environmental hazards and greatly limits the effective uses of the removed lint. The lint which is not consumed by flame or acid is not suitable for a wide range of uses and frequently must be disposed of, for example by burning, and this can create additional environmental problems if prescribed safeguards are not observed. While certain key parts of the processing equipment used in the acid treatment can be fabricated from stainless steel, much of the auxiliary equipment including conveyors, tumbling cylinders, and related accessory equipment is subject to rapid corrosion and may require replacement after only a year or two of service.

From an environmental standpoint, the proposed new totally mechanical delinting system proposed herein offers an alternative which eliminates the use of chemicals and acid that can cause pollution and contamination if special equipment and precautions are not used or followed. For these reasons the mechanical delinting system and method of this application are more environmentally friendly and less likely to be adversely affected by new laws and regulations dealing with the environment.

In order to avoid the problems of acid delinting processes, it has recently been proposed to delint cotton seed by a brushing process wherein the seed passes through a stationary horizontal foraminous cylinder while subjected to the brushing action of a series of rotating brushes within the cylinder which move the seed over the screen-like apertures in the cylinders. The lint passes through the cylinder apertures and is drawn from the apparatus by an air stream while the seed passes from one end of the cylinder to the other. Several cylinders can be employed in a given machine to sequentially receive and process the seed. Such a process and equipment are shown in U.S. Pat. No. 4,942,643, issued Jul. 24, 1990.

Although the brush delinting development would if successful eliminate the acid treatment and its attendant problems, the brush type equipment has not proven capable of removing an adequate amount of lint from the cotton seed. Furthermore, the brushing of the seed produces a fairly rapid heat build-up which seems to damage the seed, reducing its germination percentage. Applicant has been unable, using a recently developed experimental brush delinter alone, to achieve germination rates higher than about 60%- 70%, which is far below a satisfactory rate. It is believed that this level of performance of the brush delinting process is typical of that which is attainable with that process.

SUMMARY OF THE INVENTION

In the present method, the cotton seed is first passed through a saw delinter to remove a portion of the lint from the seed. Satisfactory results are obtained using a single pass through a saw delinter process. In one preferred embodiment, the saw delinting operation may be accomplished in two steps, that is by means of two sequential passes through the saw delinter. In the first pass, the saw delinter is set at a relatively coarse setting for a first level of lint removal and, in the second pass, the saw delinter is adjusted to a finer setting for additional lint removal. The partially delinted seed is then passed through a brush delinter to remove nearly all of the remaining lint.

For reasons not entirely understood, but which are believed to be based on certain principles of the present invention which are more fully set forth below, the combination of the saw delinter followed by the brush delinter provides a remarkable improvement over results attainable with prior art methods utilizing mechanical delinting means, and yields an unexpectedly clean seed product which is practically lint free and which has unexpectedly high germination rates.

While a fully satisfactory delinted seed product is obtained by the sequential passes through the saw and brush delinters, an optional flame treatment can be employed in an additional step to remove the small amount of remaining lint and even further optimize the final product.

To obtain the best rate of germination from the cleaned seed, more than 40%, and preferably an amount in the range of from about 40% to about 65% or so, of the lint should be removed by the saw delinter, and an additional amount to bring the total lint removed to more than about 95%, and preferably about 97%, should then be removed by the brush delinter. That is, in the case where about 43% of the lint is removed in the saw delinting process, from about 52% to about 54% of the initial amount of the lint should then be removed in the brush delinting process, so that the lint removed from the seed totals about 95% to 97% of the initial amount for the combination of the sequentially applied saw delinting and brush delinting process steps. The remainder of about 3% or so of the initial amount may be removed, if desired, by subsequent flame treatment.

It is accordingly a first object of the invention to provide an improved method for delinting cotton seed to be used in planting cotton.

It is a further object of the invention to provide a method as described which minimizes damage to the seed and accordingly enhances the germination of the seed.

Still another object of the invention is to provide a method as described which is more environmentally friendly and which does not involve the employment of acid or other chemicals in the delinting process.

A further object of the invention is to provide a process as described which is energy efficient and which involves a minimal amount of seed conveying and handling.

A still further object of the invention is to provide a method as described which is relatively economical in terms of the equipment required to carry out the method and which does not require frequent replacement of processing equipment.

Still another object of the invention is to provide a method as described which can be carefully controlled and which is thus ideally suited for processing small quantities of seed such as foundation seed.

Additional objects and advantages of the invention will be more readily apparent from the following detailed description of an embodiment thereof when considered together with the accompanying drawing.

DESCRIPTION OF THE PREFERRED EMBODIMENTS

Figure 1:
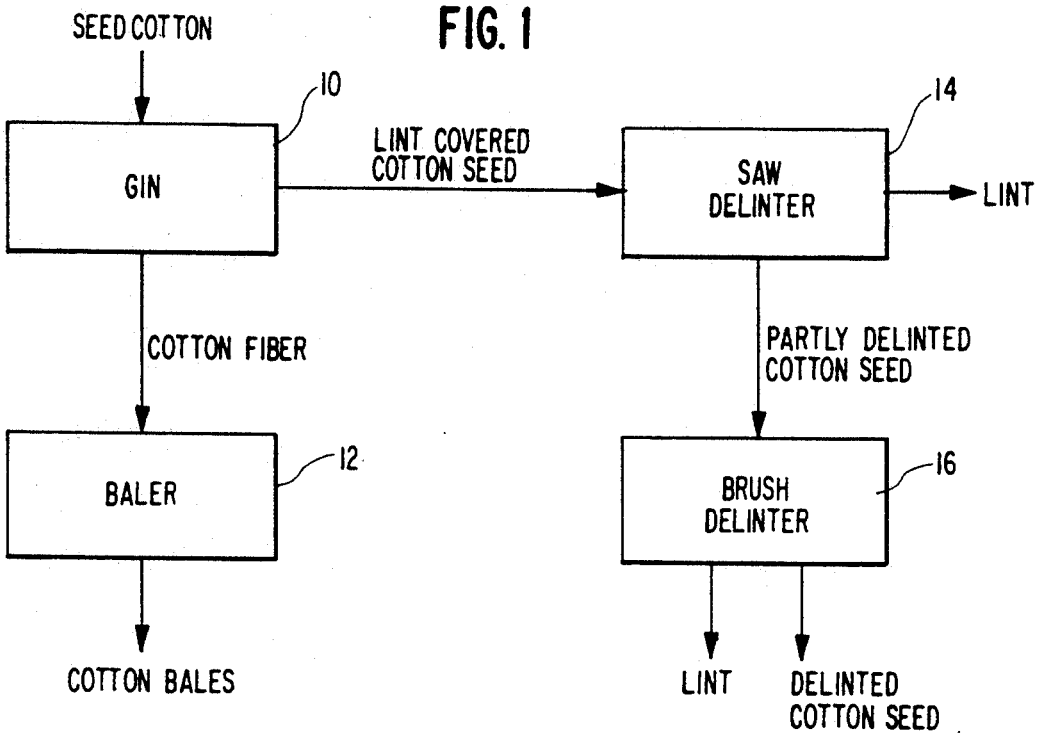
FIG. 1 is a flow diagram schematically illustrating the flow of the seed cotton components and particularly the cotton seed in a process in accordance with the present invention.

Seed cotton as it comes from the field includes the long cotton fibers and the cotton seeds entangled within the fibers. As schematically indicated in FIG. 1, the seed cotton is fed by conventional feed apparatus to a gin 10 also of conventional construction wherein the long cotton fiber is separated from the seed in a well known manner. The cotton fiber is collected in a baler 12 from which it is forwarded, typically in five hundred pound bales, to a warehouse for storage and later processing into thread or other products.

The lint covered cotton seed, following separation from the long cotton fiber in the gin is, in accordance with a first embodiment of the present invention as shown in FIG. 1, first passed through a saw delinter 14 of a conventional construction. A suitable saw delinter for this purpose is a Carver HC-2 High Capacity Delinter manufactured by Murray-Carver Inc., Dallas, Texas. This type of delinter, which is not dissimilar in construction from a conventional gin, comprises a closely spaced series of fine toothed saws mounted on a rotating drum, the spacing of the blades being wider than the longest dimension of the seed. Ribs are provided between the saw blades to permit engagement of the seed with the extending portions of the blades while serving to separate the seed from the lint gathered by the blade teeth. The lint collected by the blades is typically removed by a brush interacting with the blade teeth on the opposite side of the saws from the ribs.

Figure 3:
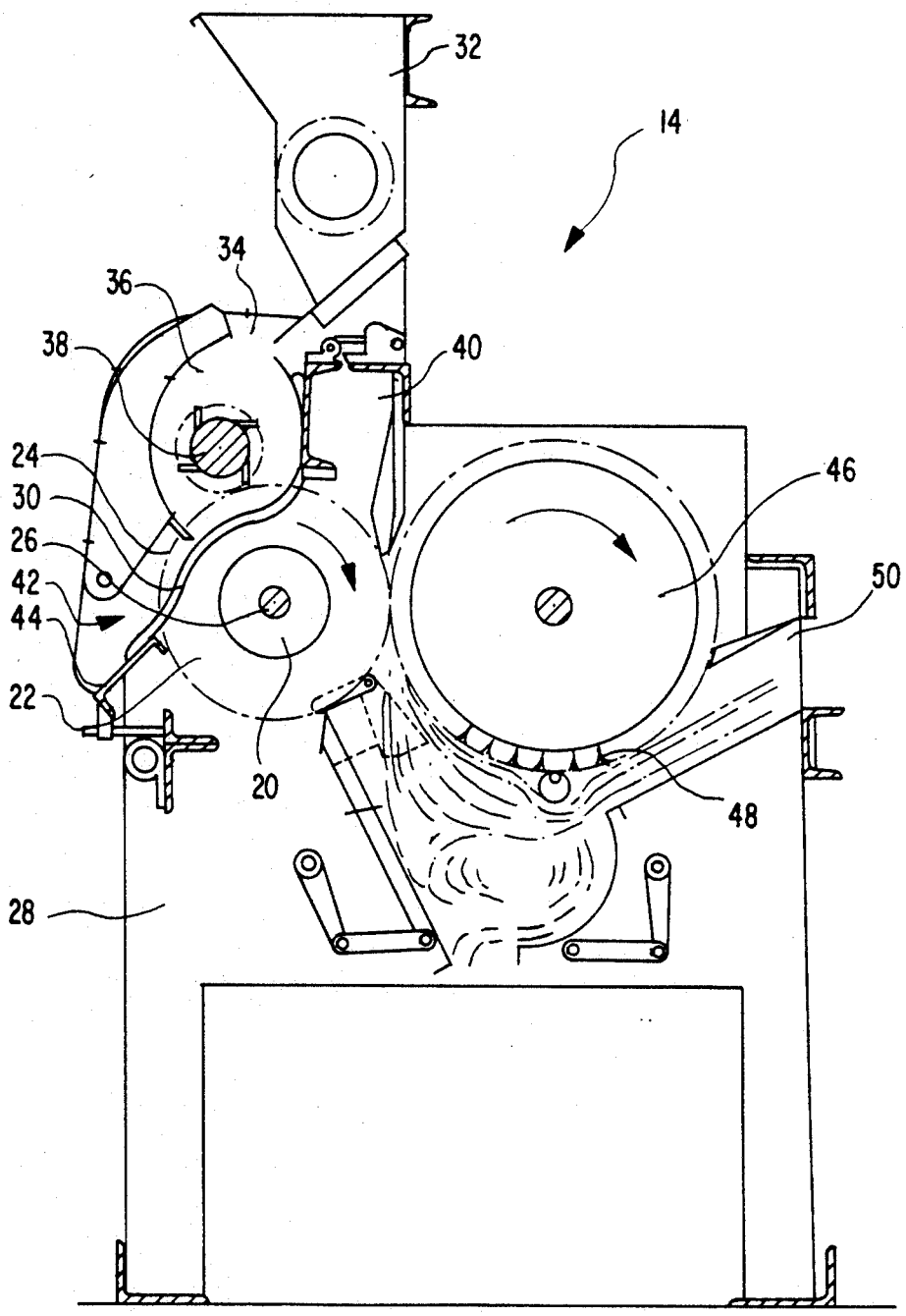
FIG. 3 is a side view of the interior of a saw delinting apparatus of the type used in the method of the present invention.

Further details of a saw delinter which is of the type which may be employed as the saw delinter 14 are shown in FIG. 3. The saw delinter apparatus shown in FIG. 3 is of a type which is well known in the art and will therefore not be described in great detail. The saw delinting apparatus comprises a rotatable saw cylinder 20 having a bank of saw blades 22 having thereon saw teeth 24 at the outer periphery thereof. The saw cylinder 20 is supported on an axle 26 which is rotatably mounted in bearings supported in a structural casing 28 of the apparatus.

The saw blades 22 extend through ribs 30 which are spaced axially along the direction of the axis of the saw cylinder 24. The clearance in the axial direction between the saw blades 22 and the ribs is less than the longest dimension of the individual cotton seeds so that the seeds are prevented from passing between the surfaces of the saw blades and the ribs as the blades rotate through the ribs.

In the apparatus illustrated in FIG. 3, the saw cylinder rotates in a clockwise direction as shown by the arrow. The lint covered seed in introduced into the saw delinter through a feeder 32 and into an upper feed opening 34 and from there into a roll box 36. The roll box 36 contains a rotatable float 38 as commonly provided in this type of apparatus.

The saw blades 22 interact with the ribs 30 to remove lint from the seeds and the lint is carried forward primarily by the saw teeth 24 into a saw chamber 40 while the seed are restrained by the ribs 30 and are retained in the roll box 36 until discharged therefrom by gravity through a discharge opening 42. The cross sectional area of the discharge opening is controlled by positioning an adjustable tang element 44 to either restrict or open up the flow of the partially delinted seeds from the saw delinting operation.

By controlling the position of the tang element 44 to either increase or restrict the flow of the seeds from the discharge opening 42, the dwell time of the seeds in the roll box 36 can be either extended or shortened. The degree of delinting performed by the saw delinting operation can thus be controlled. That is, the longer the seeds are constrained to dwell within the roll box 36, the greater the amount of lint which will be removed therefrom by the repeated interactions between the seeds and the saw delinting apparatus.

The spacing between the ribs 30 may also be adjusted to control the clearance between the saw blades 22 and the ribs 30, thereby providing another parameter through which the level of delinting may be controlled, although, as mentioned above, such clearance is usually and preferably maintained at a dimension which is less than the longest dimension of the seeds.

After the lint has been removed from the seeds and carried by the saw teeth 24 into the saw chamber 40, the lint is removed from the saw blades by a cylindrical brush 46 containing brush elements 48 and is extracted from the apparatus through a lint discharge chute 50.

In the process illustrated in FIG. 1, only a single pass or cut through the saw type delinter is employed and the delinter is adjusted by the appropriate setting of the ribs and the area of the discharge opening 42 to remove about 40% to 60% of the lint from the seed. Although seed passage through the saw delinter has a slightly deleterious effect on the seed coats and hence on the germination of the seed, this is relatively minor when only a portion of the lint is removed from the seed and comparable to that already incurred necessarily in the ginning operation.

It is known that saw delinting as used in the prior art causes physical damage (e.g., structural damage) to the seeds, thereby greatly reducing the germination rate of the seeds which are delinted by this process. Based on the principles of the present invention, it is believed that saw delinting may cause most of this damage during the latter phases of the operation after the initial portions of the lint have been removed and during the removal of perhaps the final one-third or so of the lint from the seed. In accordance with the present invention, the saw delinting process is discontinued before more than about two-thirds of the total amount of the lint is removed from the seed in that process. It has been found that more than about 40%, and up to about 60%, of the total amount of the lint on the seed should be removed in the saw delinting process before that process is discontinued.

After the seed has been subjected to the saw delinting process as just described, the partially delinted cotton seed is removed from the saw delinter and is passed through a brush delinter 16, such as the experimental brush type delinter referred to above which has recently been developed by L. T. Kincer Co., Lubbock, TX, and designated Model 3-96 "Kinco Delinter". This particular machine comprises a series of three fixed horizontal foraminous cylinders arranged in a stack or stand, each cylinder having a plurality of rotating brushes longitudinally extending therethrough, preferably in a helical arrangement. The cylinders are disposed within a housing, and air is introduced at the upper end of the housing and withdrawn by a blower from the lower end of the housing. A brush delinter of this type is shown in the above-mentioned U.S. Pat. No. 4,942,643.

In the operation of the brush delinter, the seed is gravity fed into the upper cylinder and moved by the brushes across the screen-like inner surface of the upper cylinder. Lint is mechanically removed from the seed by engagement of the moving seed with the cylinder apertures and is removed with the air flow passing through the housing containing the cylinders. The seed upon leaving the upper cylinder is transferred by a suitable chute to the intermediate cylinder which functions in the same manner as the upper cylinder to remove additional lint from the seed. If further lint removal is necessary, the seed is passed through the lower cylinder and thence to a conventional cleaning and separating operation wherein immature seed, seed fragments and trash are removed. Nearly all of the lint remaining on the seed after passage through the saw delinter is removed by the brush delinter.

Figure 5:
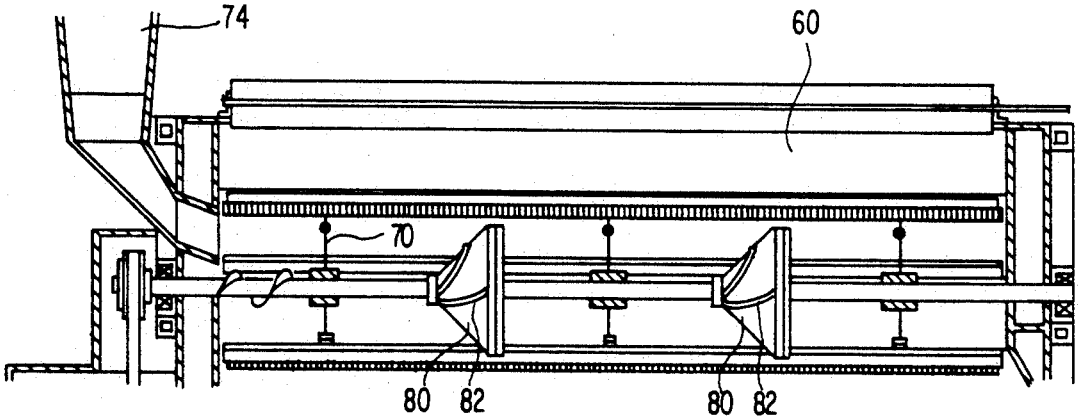
FIG. 5 is a side view, rotated 90° from the view of FIG. 4, of a portion of the interior of the apparatus of FIG. 4.
Figure 4:
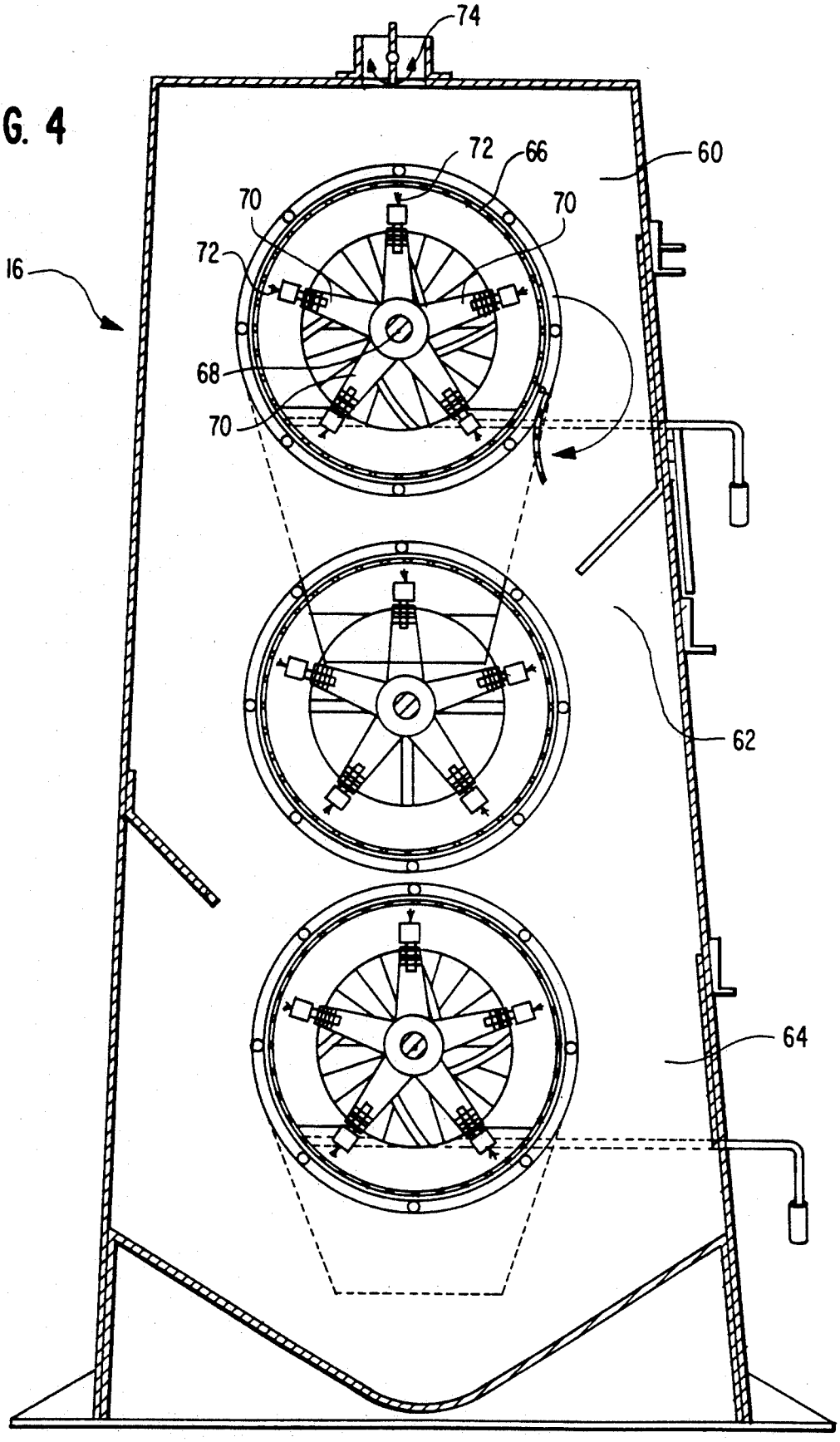
FIG. 4 is a side view of the interior of a brush delinting apparatus of the type used in the method of the present invention.

Further details of a brush delinter of the type which may be used as the brush delinter 16 are shown in FIGS. 4 and 5, of which FIG. 4 is a side cross sectional view of the interior of a brush delinting apparatus and FIG. 5 is a side view of the interior of the of one of the chambers thereof. The apparatus illustrated comprises three vertically spaced chambers 60, 62 and 64. Each of the chambers is provided with substantially identical operating sections which operate in series with each other as will be described.

Since the three operating sections of the chambers 60, 62 and 64 are substantially identical, only the apparatus within the chamber 60 will be described in detail. Positioned within the chamber 60 is a fixedly mounted cylinder 66 which is formed of a foraminous material such as a heavy gauge, perforated, metal screening material. The perforations in the cylinder 66 are of a size to permit the passage of moat therethrough while retaining the cleaned seed within the cylinder.

Positioned centrally within the cylinder 66 is a rotatably mounted shaft 68 which is supported in suitable bearings in the structure of the apparatus. Extending radially from the shaft 68 are a series of support arms 70 which are fixed to the shaft 68 to rotate therewith. Mounted at the ends of the support arms 70 are brush elements 72 which are positioned with a small operating clearance between the outer extremities of the brush elements and the inner surface of the cylinder 66.

FIG. 5 shows a fragmentary side view of the interior of the chamber 60, rotated 90° from the view of FIG. 4.

In operation, the cotton seeds are thrown radially outwardly against the screening material of the cylinder 66 and are trapped between the moving brush elements 72 and the stationary screening material. Lint is thereby removed from the seeds and forced through the perforations in the cylinder 66. As shown in FIG. 5, cone shaped elements 80 having helically shaped blade elements 82 thereon are provided to throw the cotton seeds radially outwardly against the inner surface of the cylinder 66 and to add in the circulation of air within the unit.

The seed to be delinted is introduced into the apparatus through an inlet 74 at the top thereof and flows sequentially through the three chambers 60, 62 and 64. In the brush delinting apparatus used in carrying out the present process in one preferred embodiment thereof, the radial clearances between the outer extremities of the brush elements 72 and the inner surface of the cylinders 66 was adjusted to be somewhat greater in the top chamber 60 than in the other chambers 62 and 64. This provides, in addition to the coarse lint removal step of the saw delinting process, a first stage of brush delinting which is more coarse than the remaining stages. In one apparatus in which such an adjustment was made and found to provide excellent results, the radial clearance between the brush elements 72 and the inner surface of the cylinder 66 in the top chamber was set to 0.25" and the corresponding clearances for the chambers 62 and 64 were set at 0.125".

In view of the removal of a substantial amount of the lint by the saw delinter, the energy which need be expended on the seed in the brush delinter is minimized. By the provision of an adequate air flow through the housing to prevent overheating of the cylinders, brushes, and chutes, heat damage to the seed can be minimized.

The important result of the present process is the impressive germination rates of the delinted seed product. The average germination rate in initial tests of the process illustrated in FIG. 1 to date have averaged well above 80%, comparable to acid treatment processes, and refinements of the technique such as that described below with respect to the preferred embodiment of FIG. 2, can improve the average further.

The delinted seed produced by the described above process is almost entirely free of lint, the seed coat having a clean, polished appearance with some seeds having a residual lint tuft residing primarily at their radical ends. This creates no problem in the further processing and planting of these seeds and in fact aids in seed germination by retaining moisture in the area of the seed at which germination occurs.

Since the seed undergoes no chemical treatment with the present process, the need for neutralizing any acidic condition of the seed is eliminated and the seed following its exit from the brush delinter is ready for direct passage through conventional screening equipment to remove broken or immature seed or other debris that may have found its way into the seed.

A significant advantage of the above described method is the ready collectability of 100% of the removed lint, the lint being in a clean condition since the process is entirely mechanical and involves no flame or chemical treatment and consequent damage to or destruction of the lint fibers.

Figure 2:
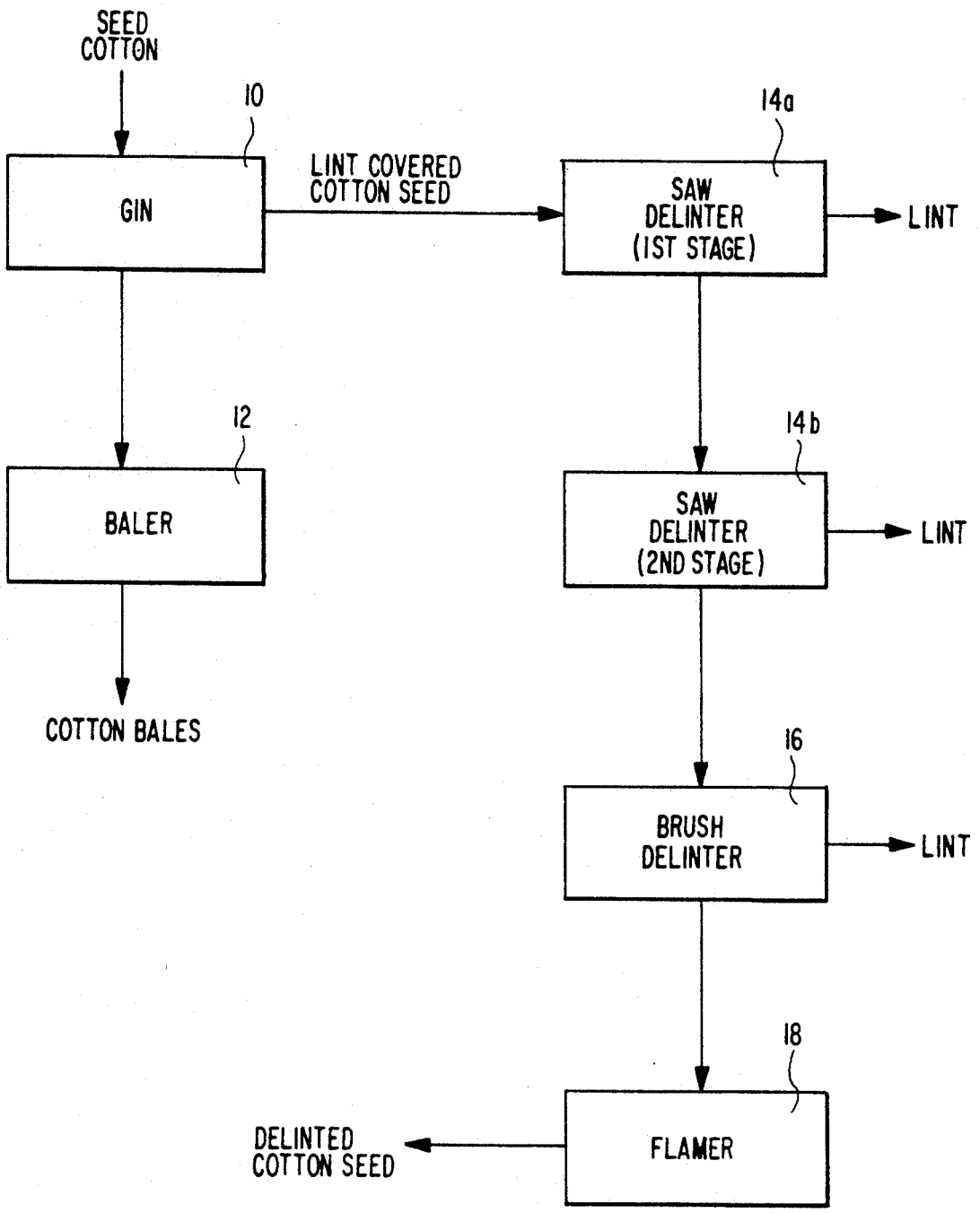
FIG. 2 is a flow diagram showing the presently preferred embodiment, which is a modification of the process of FIG. 1.

The process illustrated in FIG. 2 is a further refinement of the process of FIG. 1 and represents at the present time a preferred embodiment of the invention. With the process of FIG. 2, a germination rate of greater than 90% can be obtained. As shown in FIG. 2, seed cotton is, as in the process of FIG. 1, passed through a conventional gin 10 to separate the cotton seed from the long cotton fiber, the fiber being passed to a baler 12 to produce the standard cotton bales. The lint covered cotton seed is passed through a saw delinter 14*a* which is adjusted by adjusted by appropriate settings of the discharge opening and the ribs to remove approximately 43% of the lint from the seed in a single pass through the saw delinter 14*a*. From the saw delinter 14*a*, the cotton seed passes to a second saw delinter 14*b* which is adjusted to remove approximately an additional 20% of the total initial lint from the seed. The process accordingly differs from that of the FIG. 1 process described above in that a first stage saw delinting step is followed by a second stage saw delinting step, the combined stages removing approximately 63% of the lint from the seed.

From the saw delinter 14*b*, the seed is passed into brush delinter 16 of the same construction as that described with respect to the FIG. 1 embodiment. In the brush delinter, approximately an additional 34% of the lint is preferably removed from the seed, so that the seed on leaving the brush delinter, is left with only approximately 3% of the lint remaining. If it is desired to remove this remaining 3%, an optional step can be employed, namely passing the seed through a conventional flamer 18 to burn off any residual lint.

Figure 6:
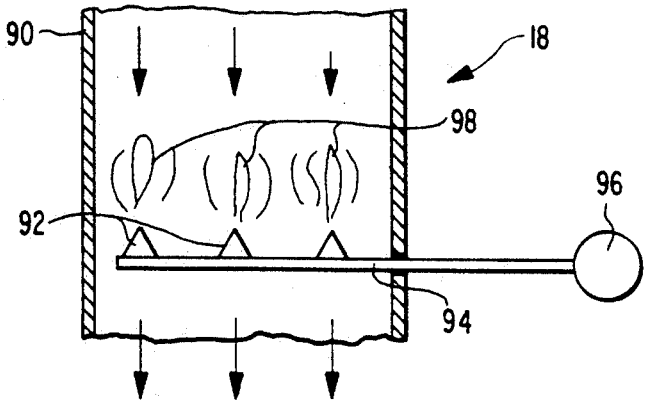
FIG. 6 is a fragmentary cross sectional view of the operational portion of a seed flamer of the type used in one embodiment of the method of the present invention.

A fragmentary cross sectional view of the operating portion of a conventional seed flamer of the type useful as flamer 18 is shown in FIG. 6. The flamer 18 comprises an outer tubular wall portion 90 into which the seed is introduced at the top thereof to flow downwardly therethrough as shown by the arrows. Burner elements 92 are supported within the tubular wall 90 by a pipe structure 94 which feeds a supply of combustion gas from a gas supply source 96.

The pipe structure 94 is open so that the seeds can fall between pipe elements which form the structure and thus pass downward through the structure. Flames 98 from the burner elements 92 form a flame front through which the seeds fall in their downward passage through the tubular wall portion 90. The seeds are thus subjected to the flames for a brief instant as they pass through the flame front formed by the flames 98 and substantially all of the remaining lint is thus singed from the seeds.

The functions of the saw delinter stages 14*a* and 14*b* as shown in FIG. 2 may be performed by a single saw delinter, such as saw delinter 14, with the seed being removed from the saw delinter 14 after the first stage pass and then re-introduced through the inlet thereof for a second stage pass through the same saw delinter.

In tests conducted using the embodiment of FIG. 2 except for the flamer 18, fuzzy cotton seed was first run through two stages of saw delinting, utilizing multiple passes through a single saw delinter as just described. In the first stage, about 43% of the total amount of the lint was removed and, in the second stage, about an additional 20% of the total amount of the lint initially on the seeds was removed. Thus, about 63% of the lint initially on the fuzzy seeds was removed in the two sequential saw delinter stages. The partially delinted seed was then run through a brush delinter to remove about an additional 34% of the lint, so that the total lint removed was about 97% of the lint initially on the fuzzy seeds. The resulting seed was found to have germination rates of about 88% to 89% in tests of the seed so delinted, which is a remarkable improvement over prior art saw delinting and brush delinting methods. Subsequent tests on delinted seed prepared in accordance with the embodiment of FIG. 2 and using the flamer 18 as a finishing step yielded germination rates above 90%.

In view of the significant increase in germination rate obtainable with the embodiment of FIG. 2, this should in most cases be the process of choice even though an additional saw delinting step is involved. Although it is not fully understood why the germination rate is so much improved by the FIG. 2 process, it may result from the smaller amount of lint removed in the brushing step, which accordingly entails less frictional contact of the seeds and hence less abrasion and heat build-up.

In any event, it has been determined pursuant to the present invention that the seed is not seriously damaged during the initial stages of lint removal by the saw delinting process of up to about two-thirds of the amount of the lint initially on the seeds. Therefore, up to about 60% to 65% or more of the lint initially present on the seeds can be removed in the initial saw delinting process without seriously adversely affecting the germination rate of the seeds. As noted above, acceptable results are attained by using a single stage of saw delinting for the initial removal of lint from the seeds. As also noted above, even better results were attained with two saw delinting stages for the initial lint removal process step. The partially delinted seed, which has been partially delinted in the initial saw delinting process, has been found to be more compatible with the subsequently applied brush delinting process. The removal of almost all of the remaining lint can therefore be accomplished by brush delinting in a process which otherwise would damage the seeds if conducted with fully linted seeds at the start of the brush delinting process.

The actual percentages of the total amount of the lint which should be removed in each of the sequential saw delinting and brush delinting steps for optimum results may vary to some extent with the variety of the particular cotton seed which is to be delinted and with local conditions, and these can be readily determined in accordance with the principles of the present invention as set forth herein. It can also be readily determined in each case whether a single stage of saw delinting will provide acceptable results when combined with the subsequent brush delinting step or whether an additional stage or stages of saw delinting before the brush delinting step will yield further improvements which are economically justified for the seed being delinted, taking into account the relevant factors which apply in each case. Even further optimization through the use of the flamer step will also be a matter of choice in each case.

From the foregoing it can be appreciated that the present process provides an improved method of delinting cotton seed which provides remarkably improved results over prior art processes and eliminates the use of acid and results in exceptional germination rates as well as the full recovery of removed lint and the recovery of almost all of the lint present on the seeds. The process is energy efficient, environmentally friendly and particularly well suited to processing small quantities of seed such as foundation seed.

Manifestly, changes in details of construction can be effected by those skilled in the art without departing from the invention.

I claim:

1. A method of delinting cotton seed while maintaining a high germination rate thereof comprising the steps of:

passing the cotton seed through a saw delinting step in which the seed is subjected to a saw delinting process to remove a portion of the lint therefrom;

said portion of the lint removed from the cotton seed by said saw delinter comprising from about 40% to about 65% thereof;

thereafter passing the partially delinted seed through a brush delinting step in which the seed is subjected to a brush delinting process to remove substantially all but about 3% or less of the remaining lint from the seed; and passing the seed from said brush delinter through a flamer to remove substantially all of said 3% of said lint.

2. A method of delinting cotton seed while maintaining a high germination rate thereof comprising the steps of:

passing the cotton seed through a first stage saw delinter to remove about 40% or more of the lint from the seed;

passing the cotton seed through a second stage saw delinter to remove an additional about 20% or more of the lint from the seed;

thereafter passing the partially delinted seed through a brush delinter to remove substantially all of the remaining lint therefrom such that less than about 3% of the lint remains on said seed; and including as a final step the passage of the seed through a flamer to remove any residual lint therefrom.

* * * * *